US005634343A

United States Patent [19]

Baker, III

[11] Patent Number: 5,634,343

[45] Date of Patent: Jun. 3, 1997

[54] BEVERAGE COOLING DISPENSER

[75] Inventor: Rex M. Baker, III, Eatons Neck, N.Y.

[73] Assignee: Alko Group, Ltd., Helsinki, Finland

[21] Appl. No.: 185,651

[22] Filed: Jan. 24, 1994

[51] Int. Cl.[6] ..... F25B 21/02

[52] U.S. Cl. ..... 62/3.64; 62/389; 222/146.6

[58] Field of Search ..... 62/3.2, 3.62, 3.64, 62/389; 222/146.6

[56] References Cited

U.S. PATENT DOCUMENTS

| | | | |
|---|---|---|---|
| D. 350,048 | 8/1994 | Kahl et al. . | |
| 1,930,220 | 10/1933 | Askin | 62/395 |
| 1,979,222 | 10/1934 | Goodwin . | |
| 2,056,800 | 10/1936 | Mohn | 62/395 X |
| 2,148,278 | 2/1939 | Rose . | |
| 2,959,925 | 11/1960 | Frantti et al. . | |
| 3,178,896 | 4/1965 | Sandsto . | |
| 3,327,485 | 6/1967 | Ter Bush | 62/3.64 |
| 3,434,302 | 3/1969 | Stoner et al. . | |
| 4,103,510 | 8/1978 | Hall | 62/430 X |
| 4,671,070 | 6/1987 | Rudick . | |
| 4,681,611 | 7/1987 | Bohner | 62/3.64 |
| 4,744,220 | 5/1988 | Kerner et al. . | |
| 4,759,190 | 7/1988 | Trachtenberg et al. . | |
| 4,914,920 | 4/1990 | Carnagie et al. . | |
| 5,042,258 | 8/1991 | Sundhar . | |
| 5,060,479 | 10/1991 | Carmi et al. . | |
| 5,301,508 | 4/1994 | Kahl et al. . | |

*Primary Examiner*—William E. Tapolcai
*Attorney, Agent, or Firm*—Pennie & Edmonds

[57] ABSTRACT

The thermo-electric cooler of the present invention is capable of cooling fluid down to below 10° F. The present invention maximizes the heat transfer path to allow better heat conductivity, and provides a space within the cooler to accommodate the thermal contraction and expansion of the cooling elements.

18 Claims, 4 Drawing Sheets

46
100
56
84
A
B
82
80
86
108
97
96
110
120

BEVERAGE COOLING DISPENSER

FIELD OF THE INVENTION

This invention relates to a novel apparatus for cooing liquids contained in bottles or individual containers using thermoelectric chips or other refrigeration technologies. In particular, the cooler of the present invention efficiently cools liquids, such as spirits, to temperatures below the freezing point of water.

BACKGROUND OF THE INVENTION

It has become popular in bars, taverns, restaurants, and similar establishments to serve ice cold shots of various liquors and spirits. As a result, a need has developed for an apparatus that can efficiently and effectively meet such cooling objectives. It is desirable that the spirits be cooled to a temperature far below the freezing temperature of water and insufficient quantity to meet a continuous demand without interruption.

The obvious way to attempt to meet this need is to store receptacles containing spirits in a conventional freezer away from the bar. The problem with using such freezers is that it is difficult and dangerous for personnel who serve spirits to handle the receptacles that are cooled to temperatures well below the freezing point of water. Furthermore, constant removal of these receptacles from such freezers causes the temperature of the spirits to increase or remain in flux. Also, for marketing reasons, it is desirable to display bottles at or behind the bar.

One attempt to improve the conventional freezer is a cooling dispenser known as the "Cool Shots™" by Cool Shots Inc. In this device, the bottle itself is not cooled, but a small amount of beverage flows into a cooling chamber. The "Cool Shots™" device, however, can dispense only one shot (1–1½ ounces) at a time because it chills only a small volume of spirits at a time. The next shot of spirits or liquors must wait to be chilled.

Thermoelectric coolers are generally known in the art for other applications, typically, to cool drinking water, or other soft drinks. For example, as discussed in U.S. Pat. No. 4,913,713, a thermoelectric cooling device or "chips" operates as a solid state heat pump. The cold junction of the chip absorbs or removes heat from a cold surface, while the hot junction of the chip pumps heat to a heat sink. The rate of heating or cooling is directly proportional to the direct current passing through the chip, and if the current is reversed the cold junction will be hot while the hot junction will be cold. It is also important to prevent moisture from contacting the chip to ensure proper operation of the chip. Thermoelectric chips may be made by using two elements of semi-conductors, such as Bismuth Telluride doped to create either an excess (N-type) or deficiency (P-type) of electrons. Thermoelectric cooling chips are commercially available from a variety of sources including MELCOR, Materials Electronic Products Corp. of Trenton, N.J.

The coolers taught by the '713 patent and related U.S. Pat. No. 4,866,945 were specifically designed for cooling a 2½ gallon jug of water. The coolers were not designed to chill water to anywhere near the freezing point of water, and thus only have to bring the water temperature down to approximately 50° F. or to temperatures suitable for drinking. U.S. Pat. Nos. 4,133,456, 4,311,017 and 4,274,262 similarly disclose thermo-electric coolers that do not anticipate chilling liquids to sub-freezing temperature range. Since the coolers taught in these references do not bring the liquids down to sub-freezing temperatures, these references do not address the problem of thermal contraction of the heat transfer and cooling elements, or the efficiency required from the cooler to achieve such low temperature and therefore not useful for the prevent application. Therefore, these devices are not capable of withstanding the stress and strain of thermal contraction and expansion.

Thus, thee is a need for a cooler that is capable of cooling liquid to this desired low temperature and, in particular, a small bar-top cooler which is capable of continuously dispensing near zero degree individual drinks.

SUMMARY OF THE INVENTION

The present invention provides a beverage cooling dispenser for cooling at least one container of liquid and for dispensing cooled liquid from said container. The cooling dispenser comprises an insulated housing which defines a chamber configured and dimensioned to receive the liquid container, said chamber being defined by a housing inner wall. The cooling dispenser also includes heat transfer elements, such as a cooling element which is mounted on said housing and having a cold side member extending through said housing into the chamber, and a cold shoe configured and dimensioned to match the shape of the liquid container, to receive and to at least partially surround said container while in contact therewith. The cold shoe is mounted on and supported by the cold side member, and is spaced away from the chamber inner wall at all points by at least a minimum predetermined distance or gap. The cooling dispenser also contains a flow control device, which is in fluid communication with the container to dispense the cooled liquid from the container. The cooling dispenser also contains a means for biasing or pressing the container against the cold shoe. The biasing means is activated when a hinged front panel of the housing is latched to the housing.

According to the present invention, a cooling and dispensing apparatus is provided, wherein a liquid can be efficiently chilled to a temperature well below ambient temperature, and also well below the freezing temperature of water at standard conditions. In the most preferred embodiment, the liquid is cooled by a thermo-electric chip. The cooler of the present invention may be used to cool or heat any type of liquids including liquids, spirits or soft drinks, and is capable of receiving a number of containers.

Novel features of present invention includes inter alia improved heat conductivity in the heat transfer elements for extracting heat from the liquid to be chilled. The present invention provides for improved contacts between the heat transfer elements of the beverage cooling dispenser. The contacting surfaces are machined and sanded smooth so that they closely match the contours of each other. This novel feature minimizes or eliminates air bubbles between these contacting surfaces that could impede the desired heat transfer from the cold side of the chip to the cold shoe.

Accordingly, an object of the present invention is to provide a beverage cooling dispenser that is both portable and capable of cooling liquid to temperatures well below the freezing temperature of water.

Another object of the present invention is to obviate handling the container which has been cooled to temperatures well below the freezing temperature of water.

Another object of the present invention is to provide a beverage cooling dispenser that can bring the temperature of the liquid down to as low as 7° F. or lower.

Another object of the present invention is to provide space that can accommodate the thermal expansion and contraction of the heat transfer elements inside the beverage dispenser.

Yet another object of the invention is to provide the beverage dispenser with the most efficient path for pumping heat from the dispenser.

Still another object of the invention is to provide a means to bias the liquid container to the heat transfer elements inside the dispenser.

DETAILED DESCRIPTION OF THE INVENTION

Figure 1:
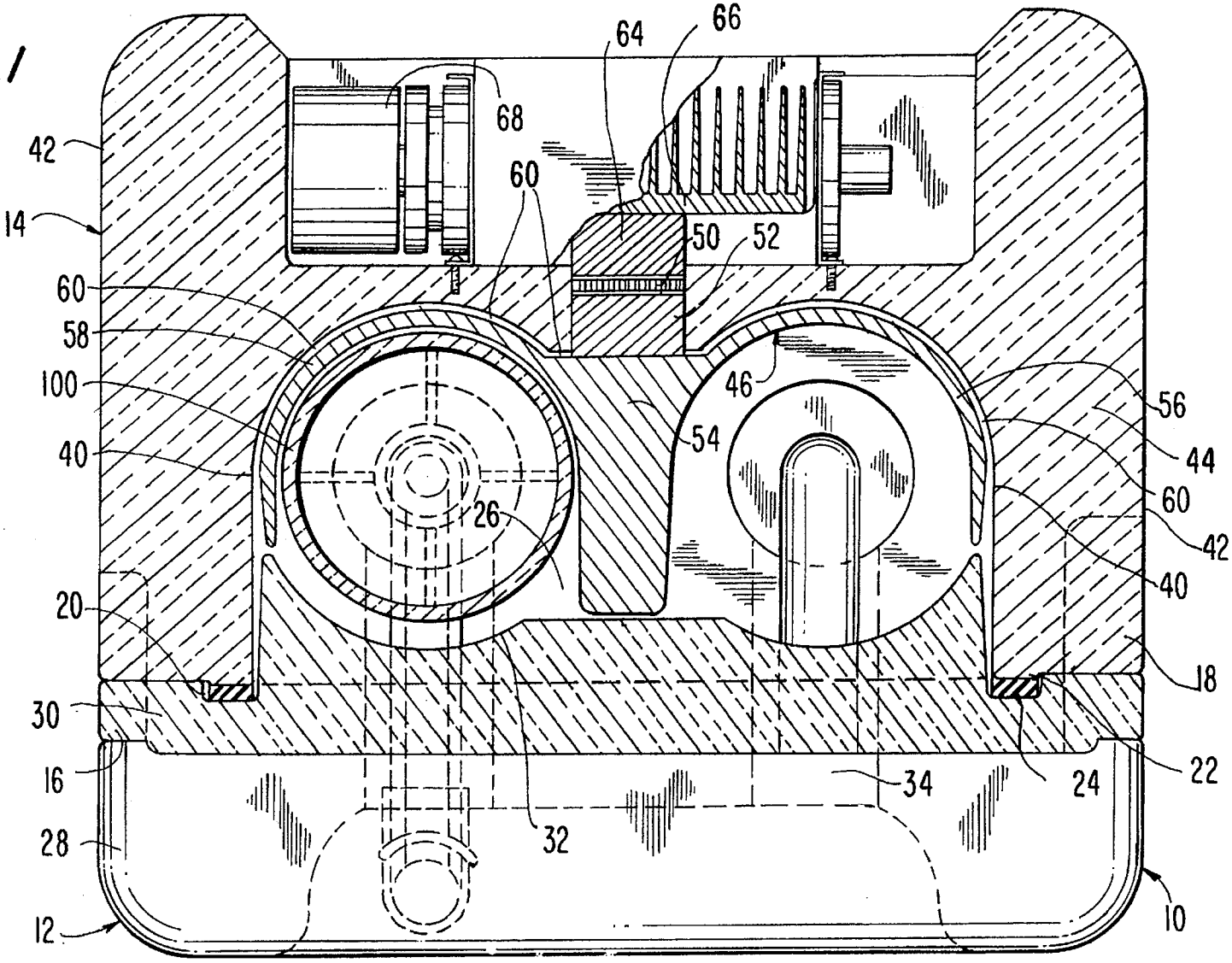
FIG. 1 is the top view of an embodiment of the beverage cooling dispenser of the present invention.

Now referring to the Figures, wherein like reference numerals are used to designate like parts and according to FIG. 1, cooler 10 comprises front panel 12 and main housing 14. Front panel 12 is pivotally attached to housing 14 by at least one hinge 16 on one side and a latch 18 on the opposite side. Front panel 12 further contains a recess 20 which is located inside and concentric to the periphery of the panel. There is also a matching ridge 22 located on main housing 14 in such a way as to fit into recess 20 when front panel 12 is fixedly latched to the main housing. Further, a seal 24 is located inside recess 20 to insure that cold air in internal chamber 26 of cooler 10 does not escape to ambient air through any gap between panel 12 and housing 14. Seal 24 may be any type of foam, magnetic or sponge-type sealants or gaskets. However, it seal 24 is magnetic there must be matching magnetic seals (not shown) on both ridge 22 and on recess 20. Front panel 12 further comprises front display 28, insulation portion 30 and inner shell 32. Inner shell 32 can assume any shape but preferably a shape that closely resembles the shape of the fluid containers to be chilled. As shown in FIG. 1, inner shell 32 preferably has an arcuate shape to match the shape of a round bottle. Also, front panel 12 further comprises at least one aperture 34 for receiving a dispensing means.

Main housing 14 comprises hard inner shell 40, hard outer shell 42 and insulation 44 located between the two hard shells. It should be noted that the inner and outer shells can be rotationally molded to be one integral piece. Outer shell 42 defines a cavity toward the back of main housing 14 to house the heat sink and the heat removal system. Inner shell 40 defines a cavity which forms internal chamber 26 when front panel 12 is fixedly latched to main housing 14. Internal chamber 26 contains the cold shoe 46 and at least one liquid container 100. Insulation regions 30 and 44 can be made out of any commercially available insulation material such as AR foam, fiber glass, styrofoam, etc.

The cooling system of cooler 10 comprises thermoelectric chip 50, cold side member 52 which is fixedly attached to chip 50, and at least one cold shoe 46 which is fixedly attached to cold side member 52. Cold shoe 46 comprises at least one cold wrap-around pad 56 or 58 and a center part 54. Each pad receives one liquid container 100. Pads 56, 58 can assume any shape to receive any type of fluid container. As depicted, pads 56, 58 have arcuate shape to receive a substantially cylindrical bottle. Similarly, inner shell 32 of front panel 12 also has an arcuate shape. As shown in FIG. 1, and more clearly in FIG. 2, chip 50 is positioned within insulation 44, and cold side member 52 is also at least partially embedded within insulation 44.

The cooler of the present invention compensates for the expansion and contraction of the cold side member 52 and the cold shoe 46. As generally known in the art, all materials expand when subject to an increase in temperature and contract when subject to a decrease in temperature. Thermal expansion and contraction are much more evident in applications intended by the present invention. As stated above, an object of the present invention is to bring a liquid from room temperature of about 70° F. to as low as possible. Initial tests have achieved temperature in the range of 0° F. to 7° F. In this temperature regime, the cooler must allow the metallic heat conducting elements to freely expand and contract. If not, when the cold side and cold shoe contract they will come into contact with the housing of the cooler. As a result, these elements will be subjected to compression stress which may result in shortening their useful life, and in severe circumstances may lead to mechanical failure.

In this preferred embodiment, a gap 60 is formed between inner shell 40 and warp-around pads 56, 58. It is noted that gap 60 extends all the way around wrap-around pads 56, 58 and center part 54 of the cold shoe 46. Gap 60 provides a space to absorb the thermal expansion and contraction of the cooling parts 52, 46, 54 and 56, 58. When cooler 10 is chilled to below 10° F., cooling elements 52, 46, 54, 56 and 58 will contract, and if there were no gap 60, wrap-around pads 56 and 58 will be pulled into contact with inner shell 40. More critically, if there were no gap 60 the resulting compression force could damage pads 56 and 58 or damage inner shell 40, or cold shoe 46 could be sheared off of cold side member 52, or cold shoe 46 could be pulled away from chip 50.

Figure 3:
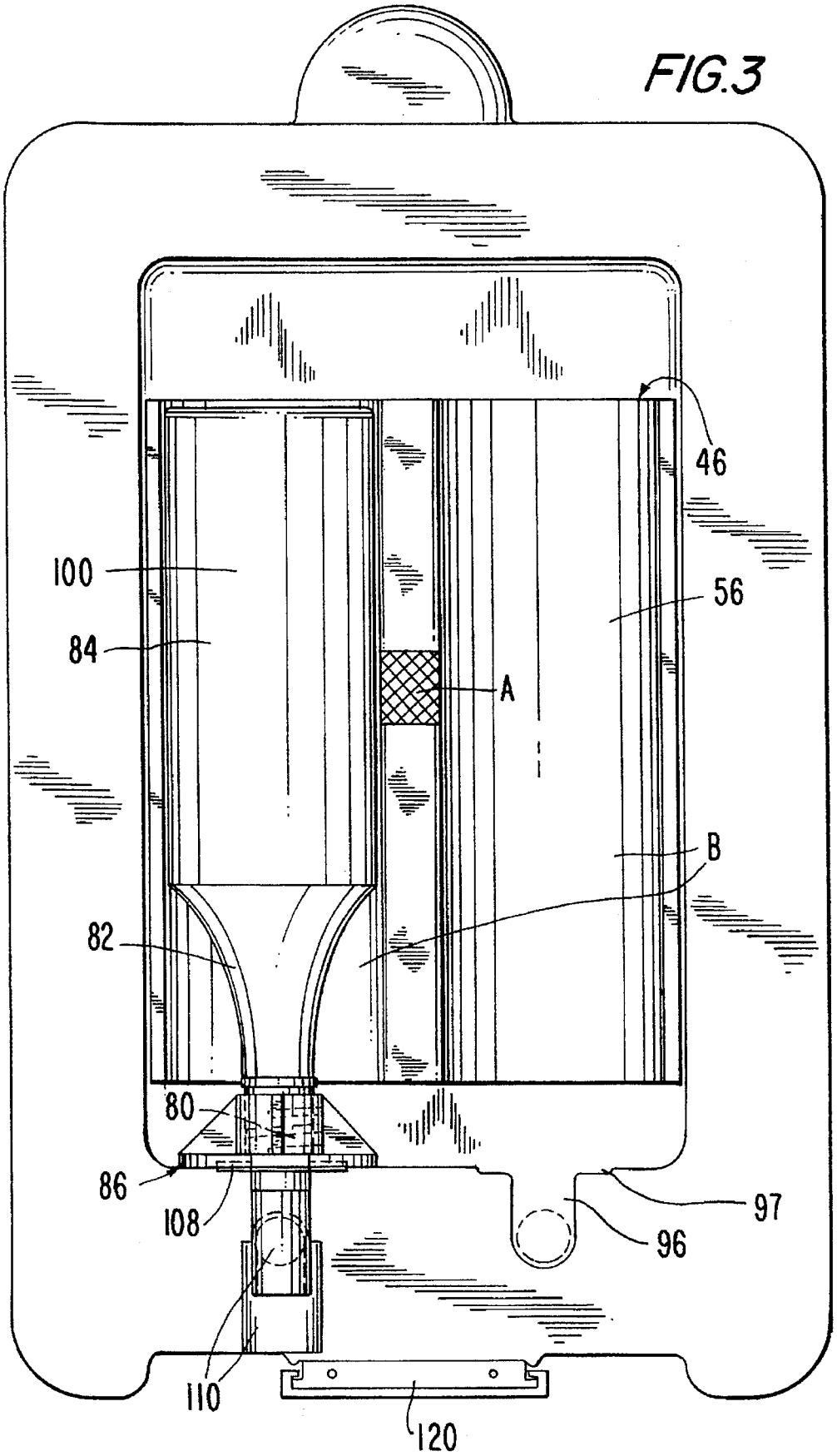
FIG. 3 is the front view of the same embodiment of the beverage cooling dispenser.
Figure 4:
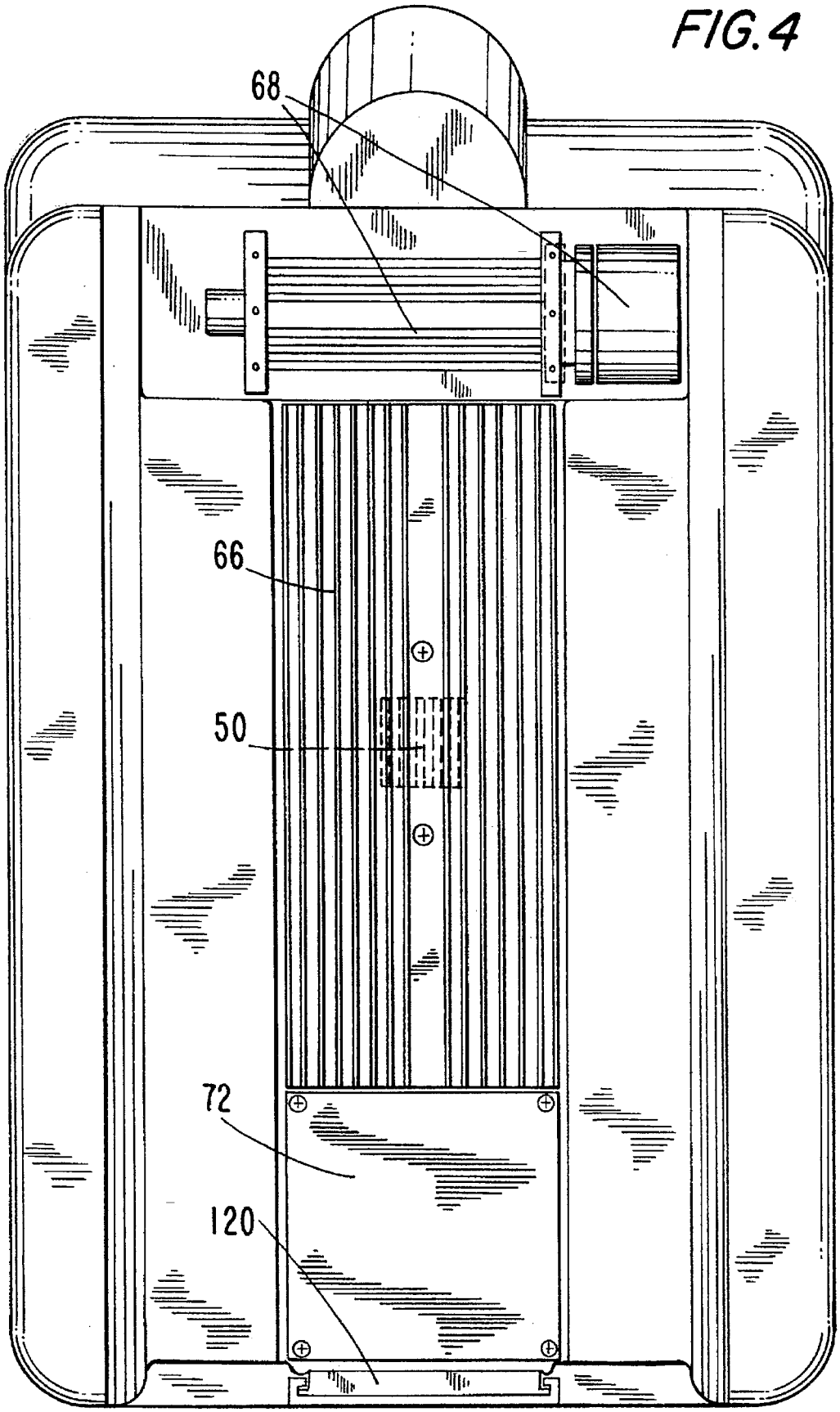
FIG. 4 is the back view of the same embodiment of the beverage cooling dispenser.

Most commercially available thermoelectric chips are relatively small in size compared to cold shoe 46 and pads 56, 58. Referring to FIG. 3, if the large pads 56, 58 are compressed into inner shell 40, the force exerted on the small contact surface (A) between cold side member 52 and cold shoe 46 is equal to the total force exerted on the large would-be contact area (B) between inner shell 40 and wrap-around shoes 56 and 58. As would be appreciated by those ordinarily skilled in the art, since area (B) is much larger than surface (A), even a small pressure on area (B) can translate to a significant force on surface (A). Thermoelectric chips by the nature of their design are particularly susceptible to separation forces. Thus, the risk of having chip 50 separated from cold shoe 46 is obviated by allowing cold shoe 46 to move relative to the housing through gap 60 during thermal contraction. The thickness of gap 60 may be calculated by using thermal expansion formula contained in standard scientific text books, such as the Handbook of Chemistry and Physics, 65th edition, published by CRC Press Inc.

To improve its efficiency, cooler 10 also includes means for improving the surface contacts between container 100 and wrap-around pad 56, 58. Such improving means includes the arcuate inner shell 32 of front panel 12 and latch 18. When front panel 12 is latched with main housing 14, shell 32 contacts container 100 and presses said container onto wrap-around pad 56 or 58. Such pressure ensures the maximum surface contacts between cold pad 56, 58 and the liquid container. This improved contacting means is especially important when the contraction of the cooling elements is taken into consideration. The contraction of the cold shoe 46 lessens the thermal contacts between the liquid container 100 and the cold wrap-around pad 56, 58, by pulling pads 56, 58 away from container 100. However, such improving means minimizes the loss of surface contacts by continuously pressing container 100 onto pad 56, 58.

To further enhance the efficiency of the heat transfer, all of the heat transfer elements connected to the thermo-electric chip are made out of a highly conductive material such as extruded metal. During the extrusion process a metal, such as aluminum or copper, in the softened state is forced through an aperture to squeeze out the air bubbles that could hinder the heat transfer. Thus, the extruded metal is denser and ore heat conductive than cast or sintered metals. Also the heat contacting surfaces between the cooling pads and the liquid containers are made large compared to the size of the thermo-electric chip. It has been discovered that large contacting surfaces improves heat transfer efficiency of the cooling elements.

The large contacting surfaces, the improved path for heat transfer and the insulation allow this cooler to be operated at the same power consumption as running an 80 watt light-bulb, and allow the size of the cooler to remain small so that it can be mounted on top of a counter, a table, its own stand or be hung from a wall.

Figure 2:
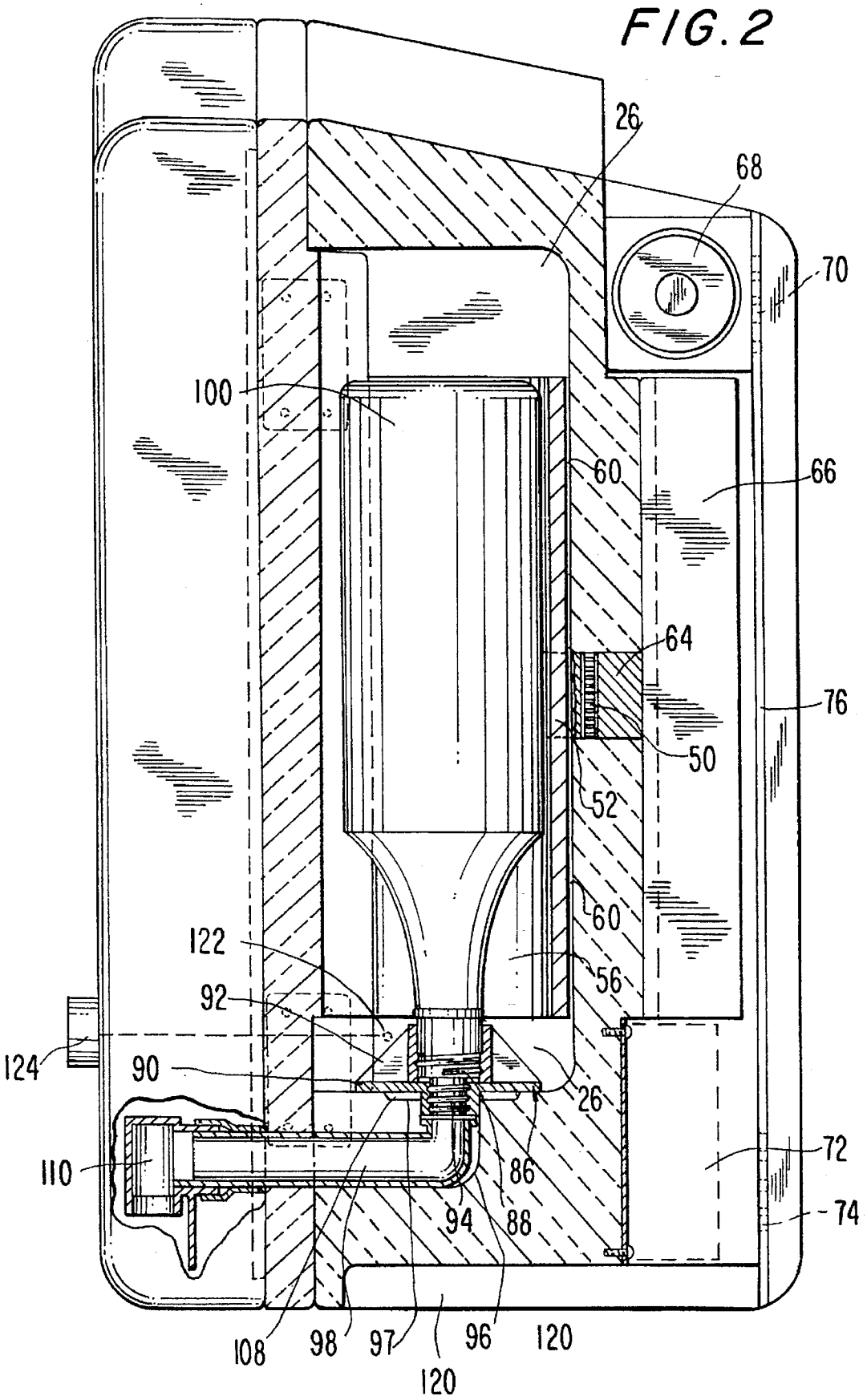
FIG. 2 is the side view of the same embodiment of the beverage cooling dispenser.

As shown in FIGS. 1 and 2, positioned opposite to cold side member 52 are hot side member 64 and heat fins 66. The contact areas between cold side member 52 and chip 50 and between hot side member 64 and chip 50 are filled with a thermally conductive greats or gel to improve the heat transfer. Fan 68 is preferably positioned above heat fins 66, but its location is not restricted to this arrangement. Fan 68 draws cool ambient air from inlet louvre 70, and forces cool ambient air first through the heat fins 66 where the air absorbs heat from fins 66, and then the warmer air is forced through the alternating-current to direct-current converter AC/DC 72 before exiting through outlet louvre 74. In this arrangement, the heat removing ability of ambient air is used to cool the heat fins first, before cooling AC/DC 72. Electrical power is carried to cooler 10 through typical electrical cords and plugs (not shown). Louvre 70 and 74 are located on back panel 72 which is fixedly attached to the back of main housing 14. It should be noted that there is no louvre opposite from the heat fins, as shown in FIG. 2, so that back panel 76 helps confine ambient air to the space directly over the heated fins. Further, louvre 70 and 74 open downward to prevent accidentally spilled liquid from entering the fan.

Container 100 is placed inside internal chamber 26 in an inverted position. As shown in FIG. 2, container 100 may be a typical cylindrical bottle, similar to the bottles for liquids, wine, soft drinks or other spirits. Container 100 comprises threaded top 80, a neck region 82 and a cylindrical main body 84. Container 100 is supported in the inverted position by stabilizing shoe 86, which comprises a thread cavity 88, a base 90, at least one supporting fin 92 connecting the cavity 88 to the base 90, and a threaded connector 94. Threaded top 80 of container 100 is received in threaded cavity 88 of the stabilizing shoe 86. In the present invention, four triangular fins 92 are shown, but any number of fins having any shape can also be used.

Threaded connector 94 is connected to elbow-conduit 98 which has mating threads for receiving connector 94, as shown in FIG. 2. Conduit 98 is in fluid communication with both container 100 and spigot means 110. Spigot means 110 can be any known and commercially available spigots or valves having closed and open positions. When spigot 110 is in the open position, chilled liquid will be dispensed.

Main housing 14 of cooler 10 further comprises channel 96 for receiving conduit 98, and a recess 97 which is located above channel 96 to receive a gasket 108, as shown in FIG. 2. Gasket 108 prevents cold air from inside internal chamber 26 from escaping. Furthermore, front panel 12 also contains an aperture 34 located opposite from channel 96 for conduit 98 to pass from main housing 14 to the spigot 110 which is located external to cooler 10. Main housing 14 also includes at least one locking plate 120 located at the bottom the housing 14 for fixedly attached cooler 10 to a table, counter-top or stand, and front display panel 28 for receiving decorative or ornamental designs as well as the brand name.

The cooler of the present invention may also be practiced singly or in combination with other embodiments. In one such embodiment, the contraction or expansion of the cold side member and cold shoe is absorbed by a soft inner shell 40. Thus, as the cold side member and cold shoe contract, soft inner shell 40 partially but resilient collapses. In this embodiment, gap 60 is not required.

In another embodiment, the air space in chamber 26 is used as an insulation. This embodiment further comprises a means to create at least a partial vacuum in internal chamber 26, and/or in the insulation region 44. As generally known in the art, a vacuum prevents heat transfer by conduction and convection, leaving radiation as the only path for heat flow. By depriving two of three paths for heat to flow from the warm ambient toward the cold internal chamber 26, it would be more efficient to keep cooler 10 cold. A conventional air pump (not shown) installed on cooler 10 and in fluid communication with chamber 26 can accomplish this purpose.

It should also be noted that the internal chamber 26 can be dimensioned to minimize the air space in the internal chamber by forming the cold shoe to closely match the liquid container and forming the internal chamber around the cold shoe.

Yet in another embodiment, the air space in internal chamber 26, including gap 60, is used as a heat conductive medium, instead as an insulation. Since chamber 26 is sealed, it may be filled with a heat conductive fluid such as glycol. Said heat conductive fluid would be in contact with cold wrap-around pad 56, 58 and being cooled by same. Since the cooled fluid is in contact with container 100, it evenly removes heat from the parts of container 100 that are not in contact with pad 56, 58 such as neck 82 and uncontacted region of cylindrical body 84.

Yet in another embodiment, chip 50 is positioned closer to heat fins 66. In this embodiment, the length of the hot side member 64 is reduced and in certain applications can be eliminated all together. Thus, the path that the heat has to travel before reaching heat fins 66 is reduced to improve the heat removal capacity of cooler 10.

Yet in another embodiment, multiple containers 100 may be chilled simultaneously. In this embodiment, more than one thermo-electric chip may be used, and multiple wrap-around pads may be used in conjunctions with multiple cold shoes, wherein one cold shoe comprises two wrap-around pads, or a pad is connected on both sides by center part 54 to adjacent pads.

Yet in another embodiment, cooler 10 further comprises an internal reservoir located below container 100, wherein the reservoir has a pre-measured volume. In this embodiment, the spigot means further comprises a second valve which is positioned between container 100 and said reservoir. When the spigot is in the open position, the second valve is closed thereby isolating the liquid in container 100. A pre-measured amount of chilled liquid in said reservoir is then dispensed. When the spigot is in the closed position, the second valve is opened allowing chilled liquid to be stored in said reservoir awaiting to be dispensed.

Yet in another embodiment, spigot 110 also contains an air breathing tube. During dispensing, ambient air is allow to enter container 100 to replace the volume of liquid dispensed. The air tube allows easier dispensing, and prevents the creation of a partial vacuum inside container 100. Also, the center part 54 shoe and the cold wrap-around pad of the cold shoe can be made integral to each other to eliminate any problem with impedance to heat flow at the surface contacts. Additionally, the cooler of the present invention may be equipped with a thermocouple 122 disposed inside the internal chamber, and a display means 124 electrically connected to the thermocouple disposed external to same as shown schematically in FIG. 2. Thus, the temperature of inside the cooler can be displayed and continuously monitored.

While various embodiments of the present invention are described above, it is understood that various features of the preferred embodiments can be used singly or in any combination thereof. Therefore, this invention is not to be limited to only the specifically preferred embodiments depicted herein.

I claim:

1. An apparatus for cooling at least one container of liquid and for dispensing cooled liquid from said container, comprising:

an insulated housing defining a chamber configured and dimensioned to receive the at least one liquid container, said chamber being defined by a housing inner wall;

at least one cooling element mounted on said housing and having a cold side member extending through said housing into the chamber;

a cold shoe configured and dimensioned to match the shape of said at least one liquid container and receive and at least partially surround said container while in contact therewith, said cold shoe being mounted on and supported by the cold side member, and spaced away from the chamber inner wall by at least a minimum predetermined distance;

a flow control device communicating with said at least one container to dispense liquid from the container in said chamber;

a hinged front panel for accessing said chamber, wherein said front panel biases the at least one container against the cold shoe;

at least one hinge connecting the front panel to the housing on one side of the front panel, said front panel having a periphery;

at least one latch to secure the front panel to the housing wherein said latch is positioned on a side opposite to the at least one hinge; and a sealing member positioned concentrically inside the periphery of the front panel.

2. An apparatus for cooling at least one container of liquid and for dispensing cooled liquid from said container, comprising:

an insulated housing defining a chamber configured and dimensioned to receive the at least one liquid container, said chamber being defined by a housing inner wall;

at least one cooling element mounted on said housing and having a cold side member extending through said housing into the chamber;

a cold shoe configured and dimensioned to match the shape of said at least one liquid container and receive and at least partially surround said container while in contact therewith, said cold shoe being mounted on and supported by the cold side member, and spaced away from the chamber inner wall by at least a minimum predetermined distance;

a flow control device communicating with said at least one container to dispense liquid from the container is said chamber;

a hinged front panel for accessing said chamber, wherein said front panel biases the at least one container against the cold shoe; and a stabilizing shoe for holding said at least one container in a vertical orientation with its opening facing downward.

3. An apparatus for cooling at least one container of liquid and for dispensing cooled liquid from said container, comprising:

an insulated housing defining a chamber configured and dimensioned to receive the at least one liquid container, said chamber being defined by a housing inner wall;

at least one cooling element mounted on said housing and having a cold side member extending through said housing into the chamber;

a cold shoe configured and dimensioned to match the shape of said at least one liquid container and receive and at least partially surround said container while in contact therewith, said cold shoe being mounted on and supported by the cold side member, and spaced away from the chamber inner wall by at least a minimum predetermined distance;

a flow control device communicating with said at least one container to dispense liquid from the container in said chamber; and a hinged front panel for accessing said chamber, wherein said front panel biases the at least one container against the cold shoe;

wherein the front panel has an inside surface configured and dimensioned to match the shape of the at least one container.

4. The apparatus according to claim 3, wherein the flow control device comprises at least one conduit and at least one spigot having an open and a closed position, wherein the spigot is in fluid communication with the at least one container of liquid via the conduit, wherein the housing further comprises a channel for receiving the conduit, and the front panel further comprises an aperture for receiving the conduit.

5. The apparatus according to claim 4, wherein the cooling element is a thermoelectric chip having a hot side member and said cold side member.

6. The apparatus according to claim 5, wherein the apparatus further comprises a heat removal system, which comprises a fan, heat fins in thermal contact with the hot side member of the thermo-electric chip, a channel defined by the housing wherein the channel houses the fan, the heat fins and an alternating-current to direct-current converter, and a plurality of louvre for air inlet and outlet, wherein ambient air is drawn into the channel through the inlet louvre by the fan and is forced to pass through the heat fins and the alternating-current to direct-current converter before exiting through the outlet louvre, and wherein the inlet and outlet louvre define openings facing downward.

7. The apparatus according to claim 6, wherein a contact area between the cold side member and the cold shoe comprises at least two smoothly machined surfaces, and wherein a contact area between the hot side member and the heat fins comprises at least wo smoothly machined surfaces.

8. An apparatus for cooling at least one container of liquid and for dispensing cooled liquid from said container, comprising:

an insulated housing defining a chamber configured and dimensioned to receive the at least one liquid container, said chamber being defined by a housing inner wall;

at least one cooling element mounted on said housing and having a cold side member extending through said housing into the chamber;

a cold shoe configured and dimensioned to match the shape of said at least one liquid container and receive and at least partially surround said container while in contact therewith, said cold shoe being mounted on and supported by the cold side member, and spaced away from the chamber inner wall by at least a minimum predetermined distance; and a flow control device communicating with said at least one container is dispense liquid from the container in said chamber;

wherein the cold shoe comprises a relatively thick center member and at least one relatively thin pad, wherein said at least one thin pad, wherein said at least one thin pad is configured and dimensioned to closely match the shape of said at least one container.

9. The apparatus according to claim 8, wherein the cold shoe is made from an extruded metal.

10. A combined cooler and dispenser comprising:

at least one liquid container;

an insulated housing defining a chamber configured and dimensioned to closely receive said at least one container and to minimize air spaced around said at least one container, wherein the housing includes a moveable front panel for accessing the chamber and wherein said insulated housing wholly encompasses said at least one liquid container;

at least one cooling element mounted to said housing and having a cold side member extending through said housing and into the chamber;

a cold shoe configured and dimensioned to receive, contact and at least partially surround said at least one container in said chamber, said cold shoe being mounted on and supported by the cold side member, wherein said at least one container is biased against the cold shoe; and a flow control device communicating with said at least one liquid container, whereby dispensing of chilled liquid from said at least one container is controlled;

wherein the cold shoe is mounted on and supported by the cold side member, and spaced from the housing by at least a minimum predetermined distance such that a contraction of said cold side member does not cause contact between the cold shoe and the housing; and wherein the cold shoe comprises a thick center member and at least one thin pad, wherein in at least one thin paid is configured and dimensioned to closely match the at least one liquid container.

11. The combined cooler and dispenser according to claim 10, wherein the housing further comprises:

at leas tone hinge connecting the front panel to the housing on one side of the front panel, said front panel has a periphery;

at least one latch to secure the front panel to the housing wherein said latch is positioned on a side opposite to the at least one hinge;

sealing member positioned concentrically inside the periphery of the front panel; and a receiver for mating with said at least one container of liquid, wherein said receiver holds said at least one container in a vertical orientation with its opening facing downward.

12. The combined cooler and dispenser according to claim 11, wherein the front panel has an inside surface configured and dimensioned to match the shape of the at least one container.

13. The combined cooler and dispenser according to claim 12, wherein the cooling element is a thermoelectric chip having a hot side member and the cold side member.

14. The combined cooler and dispenser according to claim 13, wherein the at least one liquid container is substantially cylindrical.

15. A combined cooler and dispenser comprising at least one liquid container;

an insulated housing defining a chamber configured and dimensioned to closely receive said at least one container and to minimize air space around said at least one container, wherein the housing includes a moveable front panel for accessing the chamber and wherein said insulated housing wholly encompasses said at least one liquid container;

at least one cooling element mounted to said housing and having a cold side member extending through said housing and into the chamber;

a cold shoe configured and dimensioned to receive, contact and at least partially surround said at least one container in said chamber, said cold shoe being mounted on and supported by the cold side member, wherein said at least one container is biased against the cold shoe; and a flow control device communicating with said at least one liquid container, whereby dispensing of chilled liquid from said at least one container is controlled;

wherein the chamber is defined by a resilient collapsible inner wall.

16. A combined cooler and dispenser comprising:

at least one liquid container;

an insulated housing defining a chamber configured and dimensioned to closely receive said at least one container and to minimize air space around said container, wherein the housing includes a moveable front panel for accessing the chamber;

at least one cooling element mounted to said housing and having a cold side member extending through said housing and into the chamber;

a cold shoe configured and dimensioned to receive, contact and at least partially surround said container in said chamber, said cold shoe being mounted on and supported by the cold side number, wherein said at least one container is biased against the cold shoe; and a flow control device communicating with said at least one liquid container, whereby dispensing of chilled liquid from said at least one container is controlled;

wherein the cold shoe is mounted on and supported by the cold side member, and spaced from the housing by at least a minimum predetermined distance such that a contraction of said cold side member does not cause contact between the cold shoe and the housing, and wherein the cold shoe comprises a thick center member and at least one thin pad, wherein in at least one thin pad is configured and dimensioned to closely match the at least one liquid container.

17. The combined cooler and dispenser according to claim 16, wherein the combined cooler and dispenser further comprises a receiver for mating with said at least one container of liquid wherein said receiver holds said at least one container in a vertical orientation with its opening facing downward.

18. The combined cooler and dispenser according to claim 17 wherein the front panel comprises an inside surface configured and dimensioned to match the shape of the at least one container.

* * * * *